US008534491B1

(12) United States Patent
Stocker

(10) Patent No.: US 8,534,491 B1
(45) Date of Patent: Sep. 17, 2013

(54) CUP HOLDER

(71) Applicant: Earl G. Stocker, Hudson, FL (US)

(72) Inventor: Earl G. Stocker, Hudson, FL (US)

( * ) Notice: Subject to any disclaimer, the term of this patent is extended or adjusted under 35 U.S.C. 154(b) by 0 days.

(21) Appl. No.: 13/688,328

(22) Filed: Nov. 29, 2012

Related U.S. Application Data

(60) Provisional application No. 61/650,647, filed on May 23, 2012.

(51) Int. Cl.

| | |
|---|---|
| ***B65D 25/00*** | (2006.01) |
| ***B65D 90/12*** | (2006.01) |
| ***B65D 21/02*** | (2006.01) |
| ***A47F 5/00*** | (2006.01) |
| ***A47K 1/08*** | (2006.01) |

(52) U.S. Cl.
USPC ..... 220/737; 220/738; 220/630; 220/23.89; 248/309.1; 248/309.2; 248/310; 248/311.2; 248/313; 248/316.8

(58) Field of Classification Search
USPC ..... 220/737, 738, 630, 632, 23.89, 647, 220/651, 638, 639, 742; 248/309.1, 309.2, 248/310, 311.2, 313, 316.8, 346.11, 346.01; 215/399
See application file for complete search history.

(56) References Cited

U.S. PATENT DOCUMENTS

| | | | | |
|---|---|---|---|---|
| 3,491,976 | A * | 1/1970 | Larson | 248/346.11 |
| 5,222,534 | A * | 6/1993 | Wilkinson, Jr. | 141/88 |
| 5,533,700 | A * | 7/1996 | Porter | 248/311.2 |
| 5,941,381 | A * | 8/1999 | James | 206/229 |
| 8,096,514 | B1 * | 1/2012 | Stocker | 248/154 |
| 8,397,941 | B1 * | 3/2013 | Stocker | 220/737 |

* cited by examiner

*Primary Examiner* — Anthony Stashick
*Assistant Examiner* — Don M Anderson

(57) ABSTRACT

A support base fabricated of a rigid material has cylindrical holes oriented at an angle with respect to a central axis. Cylindrical rods are fabricated of a rigid material. Each rod is retained within an associated hole. Each rod has an upper end located above the top surface of the support base.

1 Claim, 2 Drawing Sheets

FIG. 2
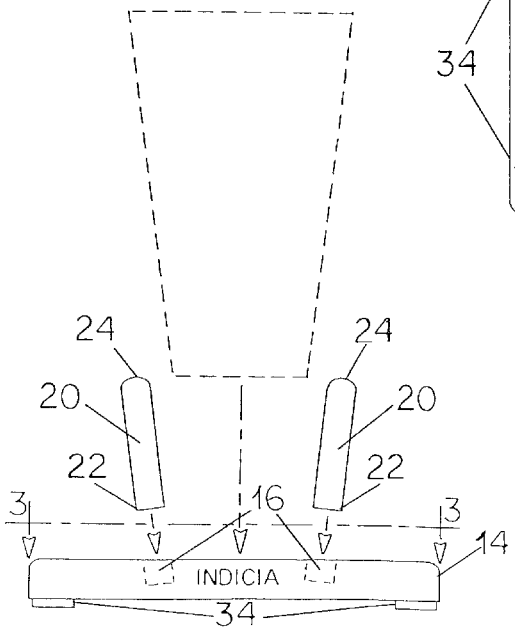
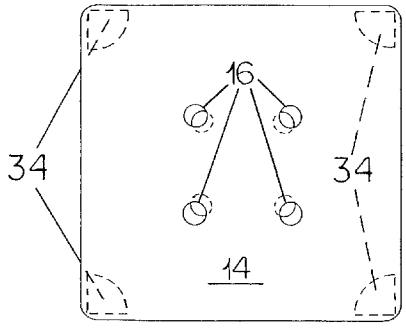
FIG. 3
FIG. 4
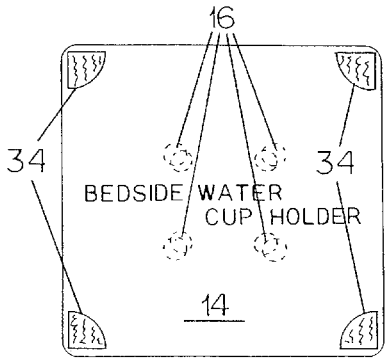

CUP HOLDER

RELATED APPLICATION

The present application is based upon Provisional Application No. 61/650,647 filed May 23, 2012, the subject matter of which is incorporated herein by reference.

BACKGROUND OF THE INVENTION

1. Field of the Invention

The present invention relates to a cup holder and more particularly pertains to removably supporting a cup frictionally on a support base.

2. Description of the Prior Art

The use of cup holders is known in the prior art. More specifically, cup holders previously devised and utilized for the purpose of removably supporting a cup are known to consist basically of familiar, expected, and obvious structural configurations, notwithstanding the myriad of designs encompassed by the crowded prior art which has been developed for the fulfillment of countless objectives and requirements.

While known devices fulfill their respective, particular objectives and requirements, the prior art devices do not describe a cup holder that allows removably supporting a cup frictionally on a support base.

In this respect, the cup holder according to the present invention substantially departs from the conventional concepts and designs of the prior art, and in doing so provides an apparatus primarily developed for the purpose of removably supporting a cup frictionally on a support base.

Therefore, it can be appreciated that there exists a continuing need for a new and improved cup holder which can be used for removably supporting a cup frictionally on a support base. In this regard, the present invention substantially fulfills this need.

SUMMARY OF THE INVENTION

In view of the foregoing disadvantages inherent in the known types of cup holders now present in the prior art, the present invention provides an improved cup holder. As such, the general purpose of the present invention, which will be described subsequently in greater detail, is to provide a new and improved cup holder and method which has all the advantages of the prior art and none of the disadvantages.

To attain this, the present invention essentially comprises a support base fabricated of a rigid material with cylindrical holes oriented at an angle with respect to a central axis. Cylindrical rods are fabricated of a rigid material. Each rod is retained within an associated hole. Each rod has an upper end located above the top surface of the support base.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved cup holder which has all of the advantages of the prior art cup holders and none of the disadvantages.

It is another object of the present invention to provide a new and improved cup holder which may be easily and efficiently manufactured and marketed.

It is a further object of the present invention to provide a new and improved cup holder which is of durable and reliable constructions.

An even further object of the present invention is to provide a new and improved cup holder which is susceptible of a low cost of manufacture with regard to both materials and labor, and which accordingly is then susceptible of low prices of sale to the consuming public, thereby making such cup holder economically available to the buying public.

Lastly, it is another object of the present invention to provide a cup holder for removably supporting a cup frictionally on a support base.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is n exploded side elevational view of the system shown in FIG. 1.

FIG. 3 is a plan view of the system taken along line 3-3 of FIG. 2.

FIG. 4 is a bottom view of the system shown in the prior Figures.

The same reference numerals refer to the same parts throughout the various Figures illustrating the preferred embodiment of the invention.

DESCRIPTION OF THE PREFERRED EMBODIMENT

Figure 1:
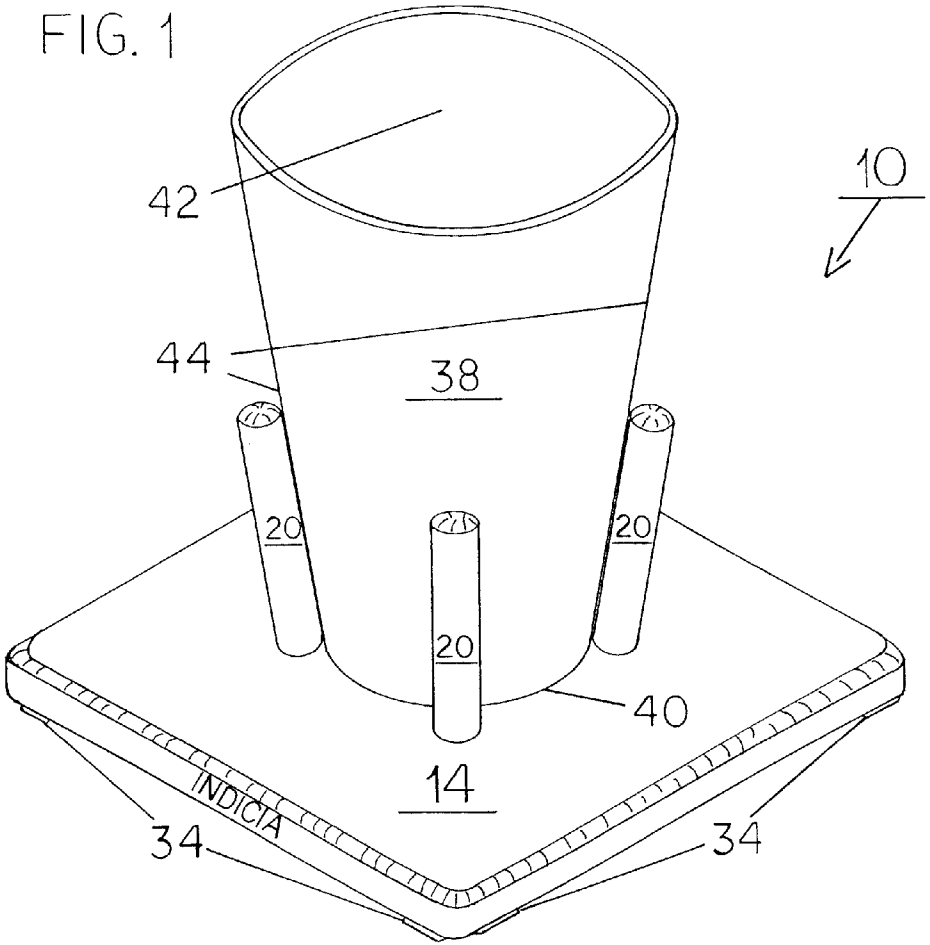
FIG. 1 is a perspective illustration of a cup holder constructed in accordance with the principles of the present invention.

With reference now to the drawings, and in particular to FIG. 1 thereof, the preferred embodiment of the new and improved cup holder embodying the principles and concepts of the present invention and generally designated by the reference numeral 10 will be described.

The present invention, the cup holder 10 is comprised of a plurality of components. Such components are individually configured and correlated with respect to each other so as to attain the desired objective. In their broadest context such components include a base, rods, cup and pads. Such components are individually configured and correlated with respect to each other so as to attain the desired objective.

In the preferred embodiment of the cup holder, first provided is a dessert cup holder 10 for releasably receiving and supporting a small cup on a larger holder base to facilitate handling by those with reduced motor skills such as younger children, elderly senior citizens and physically handicapped people. The system is safe, convenient and economical.

The system includes, in combination, a support base 14 fabricated of a rigid material. The support base is in a rectangular configuration having parallel upper and lower edges separated by a height of between 4 and 6 inches. The support base has parallel side edges separated by a width of between 4 and 6 inches. The support base has four corners with flat parallel top and bottom surfaces separated by a thickness of between 0.50 and 0.75 inch. The support base has four cylindrical holes 16. The holes are in a rectangular configuration spaced on each side between 2.1 and 2.2 inches apart. The holes are aligned with the upper and lower edges, equally spaced from the side edges, and equally spaced from the upper and lower edges. The support base has a vertical central axis. The holes are oriented at an angle of between 3 degrees and 7 degrees from the central axis, preferably 5 degrees.

Next provided are four essentially cylindrical rods 20 fabricated of a rigid material. Each rod has an exterior surface with a circular cross sectional configuration. Each rod has a diameter of between 0.125 and 0.375 inch. Each rod has a lower end 22 received and retained frictionally and adhesively within an associated hole. Each rod has an upper end 24 located between 2.50 and 2.75 inches above the top surface of the support base.

Four elastomeric pads 34 are next provided. Each pad is adhesively secured to the lower surface of the support base at an associated corner. The elastomeric pads have frictional surfaces to abate inadvertent movement when positioned on a recipient surface.

Lastly provided is a cup 38 fabricated of a generally rigid material with limited flexibility. The cup has a closed circular bottom 40, an open circular top 42, and a frusto-conical side wall 44. The bottom has a diameter of between 2.125 and 2.375 inches. The top has a diameter of between 2.875 and 3.125 inches. In this manner, the cup is adapted to be moved between a supported orientation and an unsupported orientation. The unsupported orientation is with the cup separated from the support base. The supported orientation is with the bottom of the cup positioned on the top surface of the support base and with the top of the cup secured above the rods and with the side wall of the cup in frictional contact with the rods.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the appended claims.

What is claimed as being new and desired to be protected by Letters Patent of the United States is as follows:

1. A cup holder (10) for releasably receiving and supporting a small cup on a larger holder base to facilitate handling by those with reduced motor skills such as younger children, elderly senior citizens and physically handicapped people, the system being safe, convenient and economical, the system comprising, in combination:

a support base (14) in a rectangular configuration having parallel upper and lower edges separated by a height of between 4 and 6 inches, the support base having parallel side edges separated by a width of between 4 and 6 inches, the support base having four corners with flat parallel top and bottom surfaces separated by a thickness of between 0.50 and 0.75 inch, the support base being fabricated of a rigid material, the support base having four cylindrical holes (16) in a rectangular configuration between 2.1 and 2.2 inches a side, the holes aligned with the upper and lower edges and equally spaced from the side edges and equally spaced from the upper and lower edges, the support base having a vertical central axis, the holes being oriented at a common angle of between 3 degrees and 7 degrees from the vertical central axis;

four essentially cylindrical rods (20), each cylindrical rod having an exterior surface with a circular cross sectional configuration, each cylindrical rod having a diameter of between 0.125 and 0.375 inch, each rod having a lower end (22) received and retained frictionally and adhesively within an associated hole, each rod having an upper end (24) located between 2.50 and 2.75 inches above the top surface of the support base, each of the rods being fabricated of a rigid plastic material;

four elastomeric pads (34), each pad adhesively secured to the lower surface of the support base at an associated corner, the elastomeric pads having frictional surfaces to abate inadvertent movement when positioned on a recipient surface; and a cup (38) with a closed circular bottom (40) and an open circular top (42) and a frusto-conical side wall (44), the bottom having a diameter of between 2.125 and 2.375 inches, the top having a diameter of between 2.875 and 3.125 inches, the cup being fabricated of generally rigid material with limited flexibility whereby the cup is adapted to be moved between a supported orientation and an unsupported orientation, the unsupported orientation being with the cup separated from the support base, the supported orientation being with the bottom of the cup positioned on the top surface of the support base and with the top of the cup secured above the rods and with the side wall of the cup in frictional contact with the cylindrical rods, the cup being movable between the supported orientation and the unsupported orientation.

* * * * *